US008006393B2

(12) United States Patent
Collins

(10) Patent No.: US 8,006,393 B2
(45) Date of Patent: Aug. 30, 2011

(54) HANDLE EXTENSION FOR A SHAVER OR APPLICATOR PAD

(76) Inventor: Christopher B. Collins, Encinitas, CA (US)

( * ) Notice: Subject to any disclaimer, the term of this patent is extended or adjusted under 35 U.S.C. 154(b) by 845 days.

(21) Appl. No.: 11/397,051

(22) Filed: Apr. 3, 2006

(65) Prior Publication Data

US 2007/0227015 A1 Oct. 4, 2007

(51) Int. Cl.
*B26B 21/00* (2006.01)

(52) U.S. Cl. ..... 30/526; 30/528; 30/535

(58) Field of Classification Search ..... 30/526, 30/528, 535

See application file for complete search history.

(56) References Cited

U.S. PATENT DOCUMENTS

| | | | | |
|---|---|---|---|---|
| 4,905,372 | A * | 3/1990 | Willis | 30/526 |
| 6,189,222 | B1 * | 2/2001 | Doyle | 30/531 |
| 6,266,888 | B1 * | 7/2001 | Zowaski | 30/527 |
| 6,915,580 | B2 * | 7/2005 | Dassel | 30/526 |
| 6,951,095 | B2 * | 10/2005 | Cusato | 56/400.04 |
| 7,028,407 | B2 * | 4/2006 | Ehrlich et al. | 30/526 |

* cited by examiner

*Primary Examiner* — Joseph J Hail
*Assistant Examiner* — Shantese McDonald
(74) *Attorney, Agent, or Firm* — David B. Waller

(57) ABSTRACT

A handle extension for a handheld razor or applicator pad comprising a fixed angle elongated body having a handle at one end for holding and manipulating said fixed angle elongated body and a gripping head at the opposite end for releasably fastening said handheld razor or applicator pad.

6 Claims, 5 Drawing Sheets

HANDLE EXTENSION FOR A SHAVER OR APPLICATOR PAD

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

TECHNICAL FIELD

The present invention relates to handle extensions for devices allowing the user to access areas that are difficult to reach. More particularly, a handle extension for a handheld razor or applicator pad allowing the user to shave or apply creams, emulsions, ointments or medicaments to areas on the body not easily accessible.

BACKGROUND OF THE INVENTION

The use of handle extensions for a variety of devices have been developed to allow the user to access areas that the original device was not designed, or which had not been considered, when the device was initially invented. For example, consumers commonly use disposable razors and safety razors for shaving various body parts such as faces and legs. However, such razors are limited in their overall reach due to the fact that the handle is designed to fit within the palm of the user's hand. Consequently, using such razors to reach remote locations of the body such as the lower portions of legs can require substantial effort and discomfort, especially for a person who has a physical disability, is overweight or pregnant.

There are a number of patent devices providing handle extensions for shavers. U.S. Pat. No. 4,905,372 comprising a linear handle extension having a gripping means for holding a handheld shaver on one end and a handle for manipulating the device on the other end. The gripping portion of the linear handle extension may be detached from the handle portion for more compact storage during travel. Another U.S. Pat. No. 5,911,480 ("480") comprises a shaver having a telescoping handle of at least two linear tubular shafts one inside the other having a shaving head on one end and a handle on the other. Unfortunately, linear handle extension s are difficult to orient for proper shaving of body areas such as the back. A linear handle requires that the user extend his/her arm substantially past the shoulder to achieve an angle necessary for orienting the shaving blade for effective and efficient cutting of hair on the back. Furthermore the device of patent 480 has the additional disadvantages that the linear tubular shafts are maintained in an extended position only by friction between the interacting walls of the tubular shafts. Over time and under wet conditions the friction is reduced causing the telescoped shaft to collapse. The disclosure further provides that the tubular shafts are flexible and can bend during use. Unfortunately, this has the disadvantage of reorienting the blade at an angle that is insufficient to cut the hairs close to the surface of the skin with a fixed head disposable razor.

Another U.S. Pat. No. 6,189,222 discloses an articulating handle extension for a shaver having a gripping means for affixing a handheld shaver on one end and a handle for manipulating the device on the other. The device is comprised of two or more linear shafts that are connected by interlocking spur gear joints that allow the user to adjust the handle to the desired angle prior to use by the tightening of a wing nut. Unfortunately, these joints may be difficult for the user to adjust particularly if the user does not have the strength or dexterity to untighten and tighten a wing nut such as an older individual or a person with arthritis. If not properly secured these joints can also become loose during use causing the articulating arm to collapse. Interlocking spur gear joints also add a substantial amount of weight to the device which can reduce ones ability to use the device for an extended period of time, such as the amount of time required for shaving the legs.

Therefore, there is a need for a device that has a limited number of moving parts, that requires little or no adjusting, retains a razor or applicator pad securely and allows the user to access areas on the body that are difficult to reach.

SUMMARY OF THE INVENTION

The present invention provides a handle extension for a handheld razor or applicator pad comprising a fixed angle elongated body having a handle at one end for holding and manipulating the fixed angle elongated body and a gripping head at the opposite end for releasably fastening a handheld razor or applicator pad.

In one embodiment the fixed angle elongated body is not more than 24 inches and not less than 6 inches in length. The angle or arc formed by the elongated body is not more than 165° and not less than 105°. Preferably the angle or arc is about 157°.

In another embodiment the handle extension further comprises a gripping means. Preferably the gripping means is a flexible polymer sleeve that may be affixed to the handle allowing the user to securely hold the device under wet and dry conditions.

In yet another embodiment the gripping head further comprises a hollow head in which to receive the handheld razor handle and a locking means for releasably retaining the handheld razor handle. The locking means may a plurality of axially extending slots formed through said hollow head for creating a corresponding plurality of retaining fingers between the slots which are in turn surrounded by a collar that when rotated in a clockwise direction brings the retaining fingers into contact with the razor handle thereby releasably retaining the razor. Alternatively, the locking means may be a plurality of retaining fingers which are in turn surrounded by a locking ring slidably mounted on the hollow head that when moved over the retaining fingers rotates them into contact with the razor handle thereby releasably retaining the razor.

In still another embodiment the gripping head comprises a U-shaped adapter having a pin on one end for receiving a hollow handle of a handheld disposable razor or applicator and a C-shaped snap clip to receive the neck of a handheld disposable razor or applicator on the other.

DETAILED DESCRIPTION

Figure 1A:
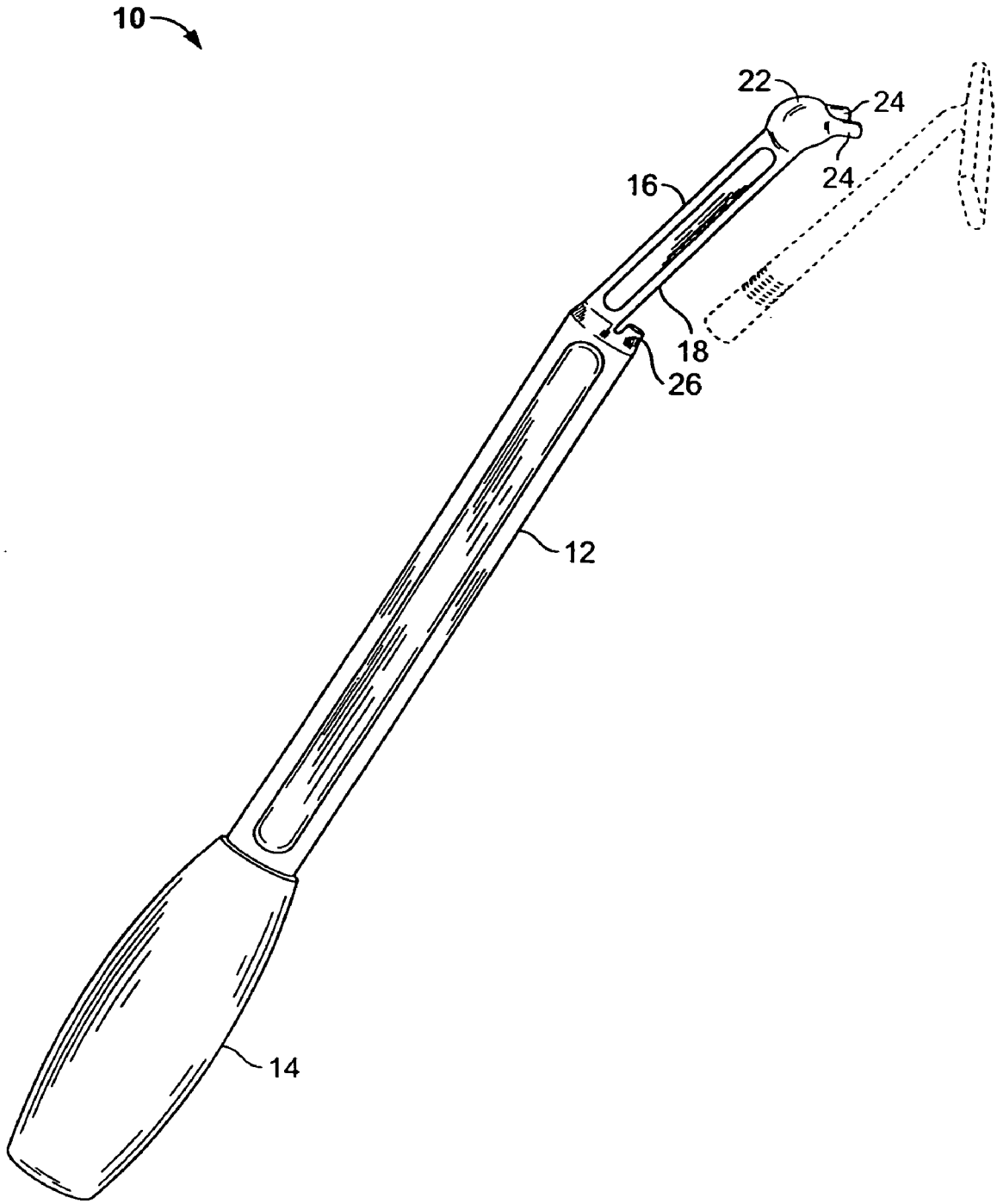
FIG. 1: Is a diagrammatic representation of one embodiment of the present invention having a U-shaped gripping head showing (A) a perspective view (B) the front view, (C) the back view, (D) the side view, (E) the top view, (F) bottom view and (G) a perspective view of one embodiment of the present invention where the U-shaped gripping head comprises a cavity for receiving the handle of a handheld razor or applicator.
Figure 1B:
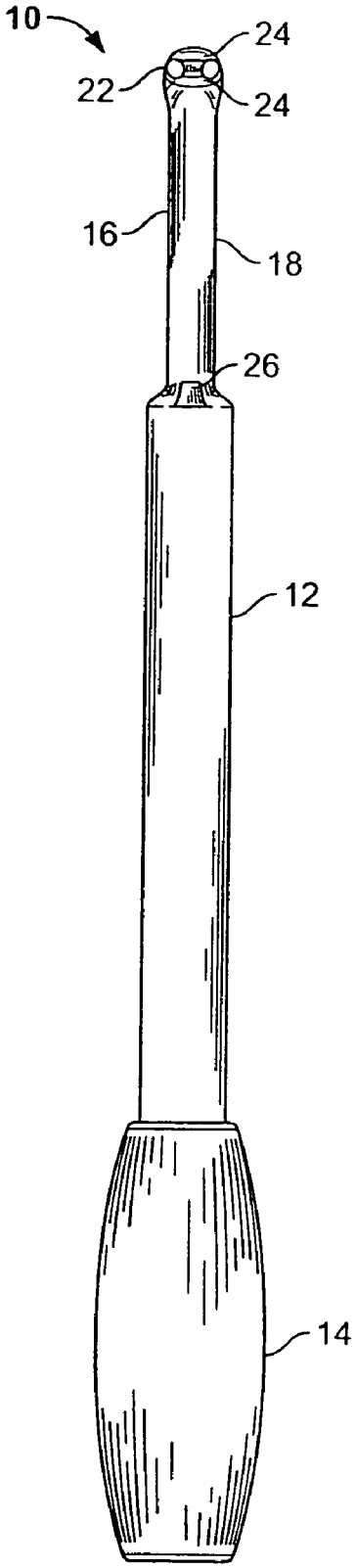
Figure 1C:
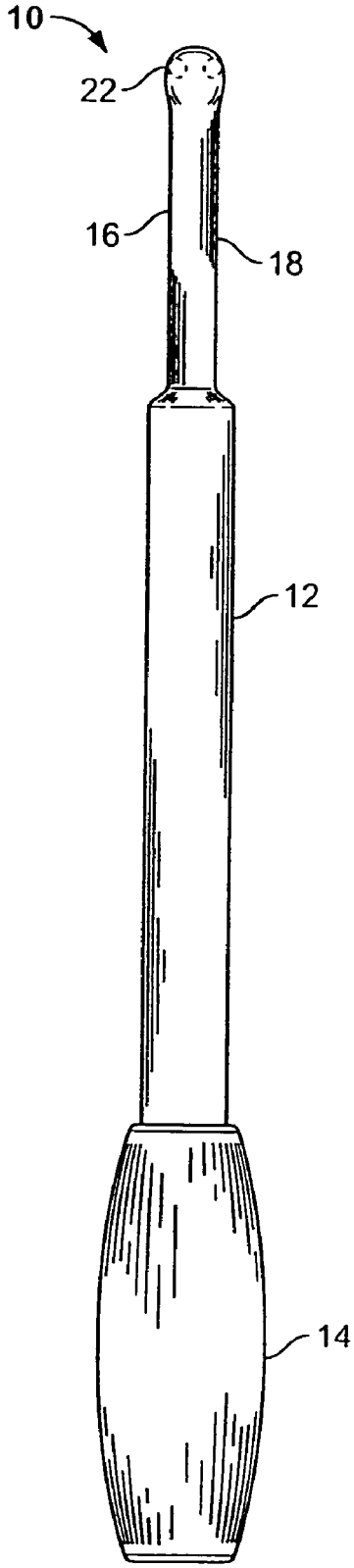
Figure 1D:
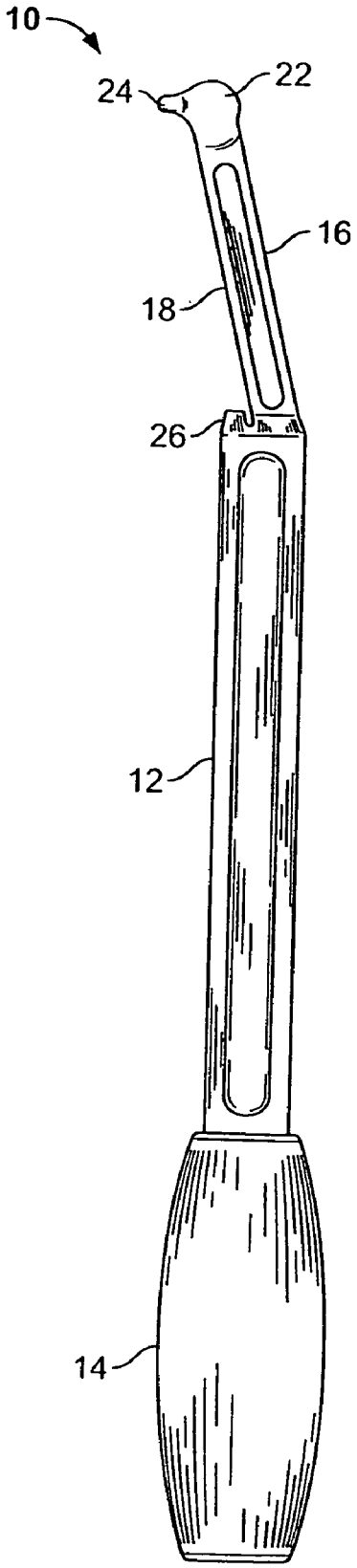
Figure 1E:
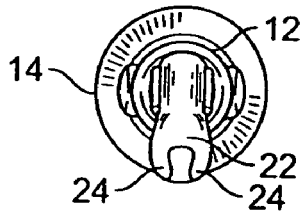
Figure 1F:
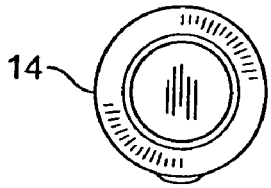
Figure 1G:
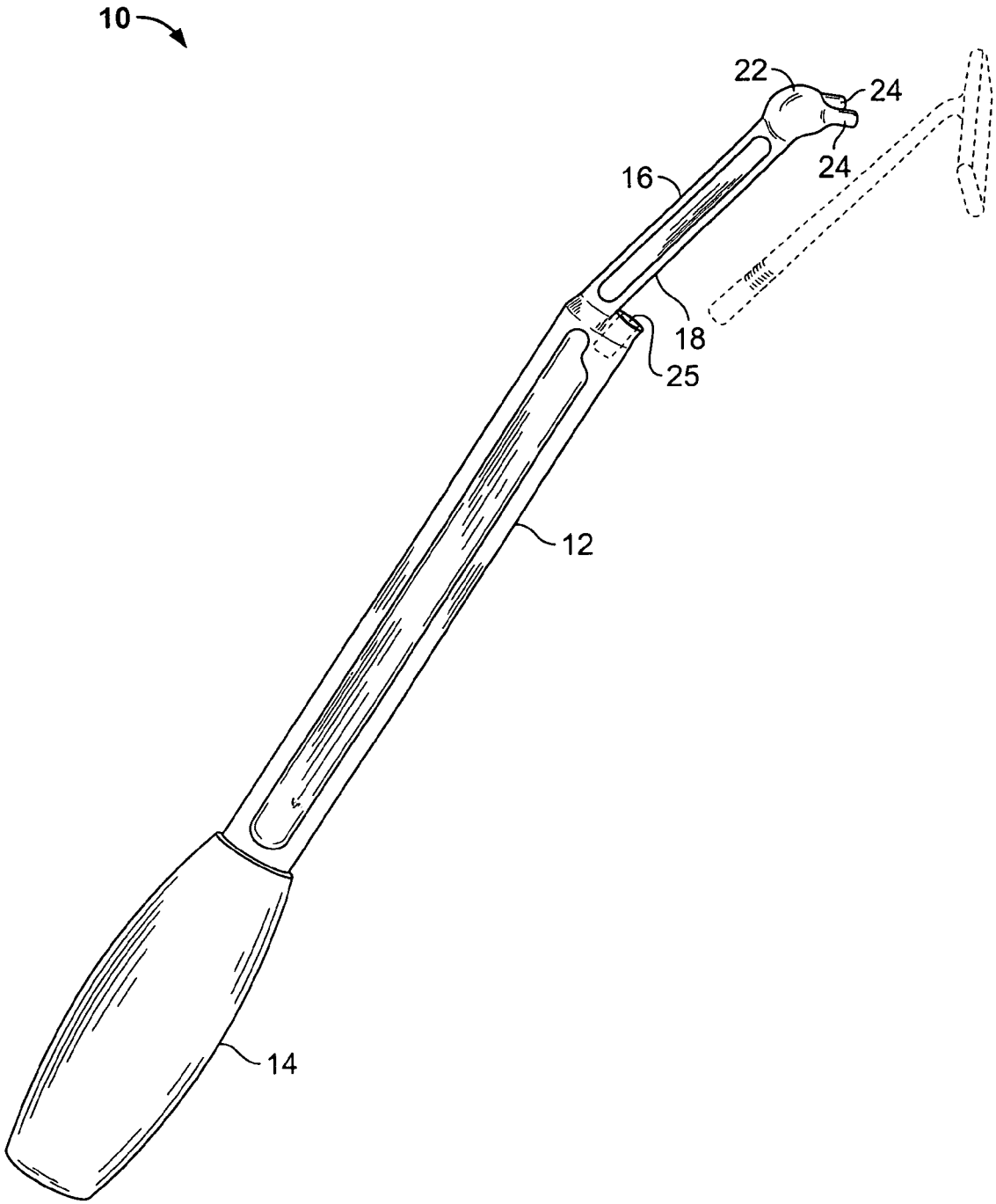
Figure 2A:
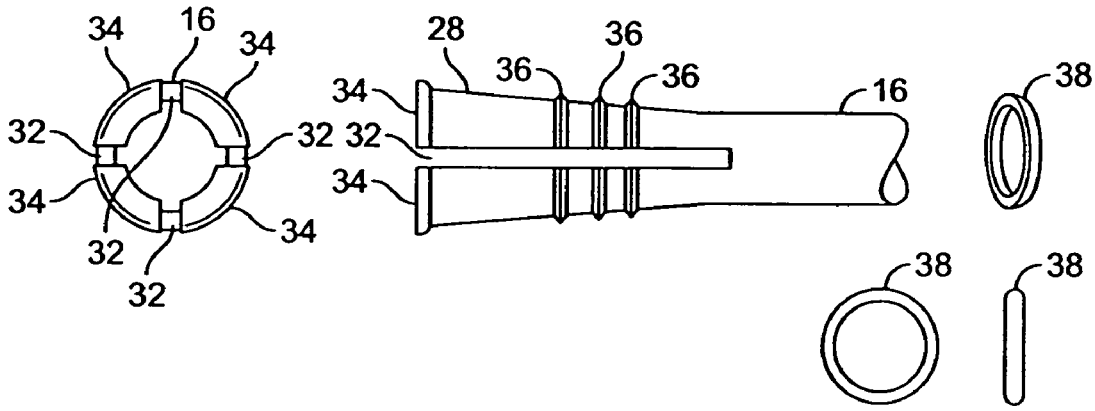
FIG. 2: (A) is a diagrammatic representation of the gripping head with a slidable locking means, and (B) is a diagrammatic representation of the gripping head with a rotating collar.
Figure 2B:
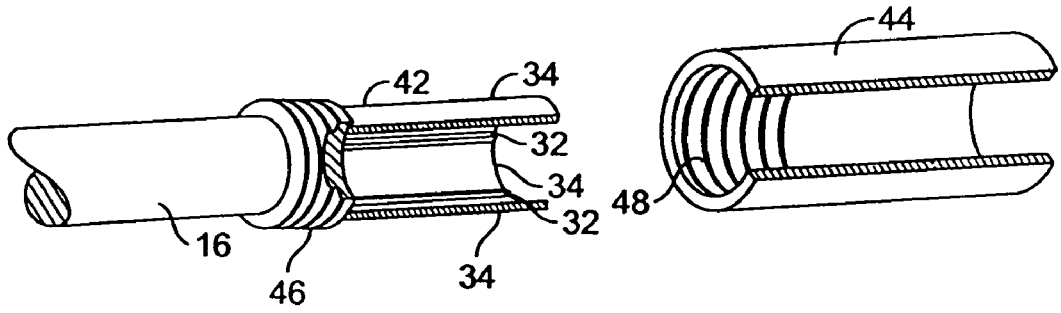

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "fixed angle" as used herein refers to the static angle or arc formed by the elongated body. More particularly, the body is prepared from a continuous length of material such as polymer plastic that is bent or molded into a non-linear form. The fixed angle is the measure in degrees created at the intersection of two lines one drawn parallel to and along the handle and one drawn parallel to and along the gripping means. Alternatively, the angle formed by a single arc is determined by the measure in degrees created at the intersection of two lines each drawn from the ends of the elongated body to the midpoint of the distance between those two ends.

The term "releasibly" as used herein refers to a the gripping ends ability to securely hold a handheld razor or applicator when desired, such as during use, and allow the handheld razor or applicator to be removed when desired, such as when being replaced.

The term "gripping means" as used herein refers to the surface of the handle of the elongated body that enhances the users grasp of the handle extension. This may be a texture provided by the mold or machined onto the surface of the handle after molding that enhances the user's grip under wet conditions. In addition, it may be a material that is applied to the handle during molding or after manufacture that that enhances the gripping quality of the handle end such as rubber.

The term "locking means" as used herein refers to a variety of methods for securing a handheld razor or applicator in the gripping head of the present invention such as for example a plurality of retaining fingers which are in turn surrounded by a collar that when rotated in a clockwise direction brings the retaining fingers into contact with the razor handle or a slidably mounted ring such that when the ring is moved over the retaining arms they are rotated into contact with the razor handle locking it in place.

The term "slidably mounted" as used herein refers to the locking ring's ability to be moved back and forth over the surface of the gripping head by the user. In one direction the locking ring is positioned over the retaining arms, rotating the arms into contact with the razor or applicator handle securely locking the razor or applicator in position. In the other direction the locking ring is moved off of the retaining arms releasing the pressure of the arms against the razor or applicator handle thereby allowing the razor or applicator to be removed easily from the handle extension.

The present invention provides a handle extension 10 for a handheld razor or applicator pad comprising a fixed angle elongated body 12 having a handle 14 at one end for holding and manipulating the fixed angle elongated body 12 and a gripping head 16 at the opposite end for releasably fastening the handheld razor or applicator pad.

Fixed Angle Elongated Body

The fixed angle elongated body 12 of the present invention provides the reach necessary to enable the user to access areas that are inaccessible with a handheld razor or applicator. This inaccessibility may be due to a particular location on the body, such as the back, or because of a particular medical condition or pregnancy. A wide variety of fixed angle configurations may be utilized to accomplish this function. The fixed angle may be formed by a single or by one or more bends that in conjunction form the desired fixed angle. In a configuration where there is a single bend, the bend may be positioned closer to either end of the elongated body 12, such as near the handle 14 or the gripping head 16 or may be positioned about the middle of the length of the elongated body 12. The bend may occur at a distance along the length of the elongated body 12 that is 10%, 15%, 20%, 25%, 30%, 25%, 40% 45% or 50% from one end. Preferably the bend is positioned near one of the ends of the elongated body 12. Most preferably near the gripping head 16 end and particularly preferred between 25% and 35% along the length of the elongated body 12 from the gripping head 16 end.

In the other configuration wherein the fixed angle is comprised of one or more bends, the bends may be in close proximity to one another or may be spaced apart. For example, the bends may be clustered in close proximity to one another positioned about the middle of the elongated body 12 or at either end. Alternatively, the bends may be spaced apart at equal distances or at variable distances from one another. For example, one bend may be positioned closer to the handle 14 and the other closer to the gripping head 16.

In another preferred configuration the fixed angle is provided by forming the elongated body 12 or a portion of the elongated body 12 into an arc. This arc may be formed over the entire length of the elongated body 12 or may be provided on at least one portion of the length of the elongated body 12. For example, the desired angle may be formed by a single arc comprising 20%, 25%, 30%, 35%, 40%, 45%, 50%, 55%, 60%, 65%, 70%, 75% 80% or 85% of the length of the elongated body 12 at a particular location. Alternatively, the desired angle may be formed by more than one arc. In this configuration the arcs may be positioned in close proximity to one another or may be spaced apart in a similar manner as that described for more than one bend above.

The desired angle can be determined based on the intended use. For example, measurements may be taken of subjects shaving legs or applying sunscreen on the back to optimize angle and length for an average person. Correspondingly, fixed angle elongated body 12 configurations having angles and lengths for individuals that are above or below the average may also be prepared based on such measurements. In general, the preferred angle is not less than 105° and not more than 165°. More preferably the angle formed is not less than 145° and not more than 160°. Most preferably between 155° and 158°.

The fixed angled elongated body 12 may be constructed from a variety of materials such as plastic, metal or wood. If it is made of metal the elongated body 12 could be die cast into the desired configuration. Alternatively if it is made of wood the plank can be formed into the desired configuration by a variety of woodworking techniques such as by sanding, cutting by band saw, shaping by chisel or by a combination of these and other techniques. In either case the metal or wood is preferably treated to resist water damage. Preferably the fixed angle elongated body 12 is constructed of polymer plastic that is form molded into the desired configuration.

The length of the fixed angle elongated body 12 will vary depending on the intended use. One skilled in the art may identify an appropriate length by determining the distance from an user's hand to the locations to be accessed. A number of such measurements may be taken to determine an average length acceptable for the uses intended. Preferably the length of the fixed angle elongated body 12 is not more than 24 inches and not less than 6 inches. Preferably the length is not more than 20 inches and not less than 8 inches. Most preferably the length is not less than 15 inches and not more than 10 inches. One skilled in the art may provide a number of preferred standard lengths for the user to select from during purchase, such as for example providing a size for individuals below the average, at average and above the average height.

The width and diameter of the fixed angle elongated body 12 will depend on its length to provide adequate structural support, the desired weight for ease of use, and the material used to construct the body. Preferably the fixed angle elongated body 12 is relatively rigid and substantially resistant to flexing during use. A variety of constructions known to those skilled in the art may be used to provide this rigidity. For example, a portion or a majority of the elongated body 12 may be provided in an I-beam configuration oriented such that the strength provided by this construction is utilized effectively to maintain rigidity and prevent flexing during use. Preferably the width is not less than ¾ inch and not more than 2 inches. Most preferably the width is not less than about ¾ inch and not more than about 1 inch.

Gripping Head

A variety of gripping heads may be utilized with the present invention to securely maintain the handheld shaver or applicator in place during use. A preferred gripping head is one that maintains the handheld razor or applicator in a position and prevents or limits movement from side to side, allows the user to easily affix, remove or replace the handheld shaver or applicator, prevents the handheld shaver or applicator from being dislodged during use and has a limited number of moving parts that could become worn or damaged.

One type of gripping head 16 of the preferred type includes a hollow, conical head 28 which is coextensively connected to and tapered outwardly (e.g. at an angle of not less than about 5 degrees and not more than about 7 degrees) from a generally cylindrical body. The thickness of the generally cylindrical body is not less than 1/16 inch and not more than 3/16 inch and is preferably about ⅛ inch. The width is not less than ⅜ inch and not more than ¾ inch, preferably about ½ inch.

The head includes a series of at least two evenly spaced, axially extending slots 32. The slot with and length will depend on the diameter of the generally cylindrical body and thickness of the handheld razor or applicator. The slot length is not less than about 1½ inches and not more than about 3 inches, preferably not less than 2 inches and not more than 2½ inches. The slot width is not less than 1/16 inch and not more than 3/16, preferably about ⅛ inch.

The slots extend through the head to create flexible retaining fingers 34, which are characterized by a spring like memory. The surface of the retaining fingers 34 that interface with the handheld razor or applicator handle may be textured or may have inserts that enhance the gripping capability of the retaining fingers 34. Such inserts can be made of, for example rubber. A series of coextensive, evenly spaced retaining flanges 36 project outwardly from the head of the gripping head 16 so as to encircle the flexible retaining finger. These flanges project outwardly to a distance sufficient to retain the locking ring 38 and allow ease in positioning the locking ring 38 over and between the flanges. The flanges are not less than 1/16 inch and not more than 3/16 inch in height and preferably about ⅛ inch. The distance between the retaining flanges 36 is selected so that a pair of adjacent flanges may accommodate a locking ring 38 in the space provided there between.

A locking ring 38 is formed from resilient material such as rubber and is adapted to slide axially along the gripping head 16 and elongated body 12 restricted to these regions by the handle 14 on one end and the gripping head 16 on the other both having diameters greater than the locking ring 38. Consequently, the interior diameter of the locking ring 38 is sufficiently large enough to slide over the elongated body 12 yet sufficiently narrow to securely hold the handle of a handheld razor or applicator when positioned within the flanges.

In operation the locking ring 38 is positioned round the elongated body 12 by expanding the ring so that it may be fitted over the gripping head or the handle 14. The handle of the disposable razor is then inserted into the hollow interior of the conical head 28 of the gripping head 16 between the flexible fingers. With the razor extending outwardly from the gripping head 16, the locking ring 38 is moved up and over the tapered head and into the space between a pair of the retaining flanges 36. More particularly, the movement of the locking ring 38 up the conical head 28 causes the flexible retaining fingers 34 to rotate inwardly and into engagement with the handle of the razor. The locking ring 38 is seated in the space between the pair of adjacent retaining flanges 36 to firmly anchor the handle of the razor or applicator in the hollow interior of the conical head 28 and between the flexible retaining fingers 34. By providing a plurality of retaining flanges 36 along the conical head 28, a variety of razor handles of varying circumferences may be retained within the hollow head by locating the ring in the space between an appropriate pair of retaining flanges 36.

In another embodiment the gripping head 16 may be a hollow receiving barrel 42 having a plurality of axially extending slots 32 formed there through for creating a corresponding plurality of retaining fingers 34 between said slots and a threaded locking collar 44. The thickness of the hollow receiving barrel 42 is not less than 1/16 inch and not more than 3/16 inch and is preferably about ⅛ inch. The width is not less than ⅜ inch and not more than ¾ inch, preferably about ½ inch.

The head includes a series of at least three evenly spaced, axially extending slots 32. The slot with and length will depend on the diameter of the receiving barrel and thickness of the handheld razor or applicator. The slot length is not less than about 1½ inches and not more than about 3 inches, preferably not less than 2 inches and not more than 2½ inches. The slot width is not less than 1/16 inch and not more than 3/16, preferably about ⅛ inch.

The slots extend through the head to create flexible retaining fingers 34, which are characterized by a spring like memory. The surface of the retaining fingers 34 that interface with the handheld razor or applicator handle may be textured or may have inserts that enhance the gripping capability of the retaining fingers 34. Such inserts can be made of, for example rubber. Retaining fingers 34 taper slightly from base to top (e.g. at an angle of not less than about 2 degrees and not more than about 3 degrees and are characterized as having a spring-like memory).

The exterior surface of the gripping head 16 receiving barrel 42 has a male threaded portion 46 and is coextensively joined to the plurality of slightly tapered retaining fingers 34 around the hollow barrel. The interior surface of the locking collar 44 has a female screw threaded portion which is coextensionally connected to a conical shaped smooth surface portion which tapers slightly (e.g. at an angle of not less than about 3 degrees and not more than about 4 degrees) from base to top. The locking collar 44 has a conically shaped interior surface along its longitudinal axis allowing it to engage the threads of the retaining fingers 34, be rotated compressing the retaining fingers 34 inward toward each other engaging the handle of the handheld razor or applicator. The diameter is such that it can receive a variety of handle diameters.

Locking collar 44 has a conically shaped interior surface along its longitudinal axis. Tightening the locking collar 44 causes the flexible retaining fingers 34 to rotate into engagement with and thereby releasably retain the handle of the handheld razor or applicator which has been inserted into the hollow receiving barrel 42 of the gripping head 16.

The locking collar 44 slides over the retaining fingers 34 whereby the female threaded portion 48 is brought into contact with the complimentary male threaded portion 46 of the exterior surface of the gripping head 16. By rotating the locking collar 44 in a clockwise direction, the interior conical surface is brought into contact with tapered retaining fingers 34 causing the retaining fingers 34 to press inwardly engaging the handle of the hand held razor or applicator.

In operation the user inserts the handle of the shaving razor or applicator into the receiving barrel 42 of the gripping head 16 and rotates the locking collar 44 in a clockwise direction, causing retaining fingers 34 to press inwardly into contact with razor or applicator handle thereby locking it in place in the gripping head 16.

In another embodiment the gripping head 16 may be a U-shaped adapter 18 having a pin 26 on one end for receiving a hollow handle of a handheld disposable razor or applicator and a C-shaped snap clip 22 to receive the neck of the handheld disposable razor or applicator. The pin 26 of the U-shaped adapter 18 is positioned closer to the handle 14 than the C-shaped snap clip 22. The pin 26 may be provided in a number of shapes or configurations that allows the handle of the razor or applicator to be securely positioned in the gripping head 16. The particular size and shape of the pin 26 will depend on the size and shapes of the hollow handles of commercially available razors and applicators. For example, the pin 26 may be a rectangular conical shape to receive the generally rectangular hollow end of the disposable razor or applicator handle. The conical shape allows a variety of different sized rectangular hollow handles to be fitted securely on the pin 26. The C-shaped snap clip 22 is provided about perpendicular to the fixed angle elongated body 12 with one or more pairs of parallel semi-flexible arms 24 spaced apart at a distance that allows the user to easily snap in the neck of a disposable razor or applicator yet with sufficient pressure exerted between the arms 24 to retain the razor or applicator head securely in the gripping head 16.

In another embodiment the gripping head 16 may be a U-shaped adapter 18 having a cavity 25 on one end for receiving the handle base of a handheld disposable razor or applicator and a three pronged snap clip to receive the neck of the handheld disposable razor or applicator. Two prongs interacting with the sides of the neck of the handheld disposable razor or applicator and a third prong interacting with the top of the head of the razor or applicator to limit the side to side and up and down motion of the razor or applicator. The cavity 25 of the U-shaped adapter 18 is positioned closer to the handle than the three pronged shaped snap clip. The cavity 25 may be provided in a number of shapes or configurations that allows the handle of the razor or applicator to be securely positioned in the gripping head 16. The particular size and shape of the cavity 25 will depend on the size and shapes of the handles of commercially available razors and applicators. For example, the cavity 25 may be rectangular to receive a generally rectangular end of the handle of a disposable razor or applicator handle. The three pronged snap clip is provided with three semi-flexible arms one on either side of the head of the razor or applicator spaced apart at a distance that allows the user to easily snap in the neck of a disposable razor or applicator and a third positioned about the top of the head of the razor or applicator to securely retain the razor or applicator in the gripping head 16.

In use the pin 26 is inserted into the hollow base of the disposable razor or applicator handle and pivoted parallel with the fixed angle elongated body 12. The neck of the disposable razor or applicator is then pressed into the C-shaped snap clip 22 securely retaining the razor or applicator in the gripping head 16.

Handle

The handle 14 may be provided in a number of configurations and diameters to provide comfort during use and to accommodate a wide variety of hand sizes. The gripping means may be provided during form molding or may be affixed following form molding. The gripping means may be a particular desired configuration or a texture molded into the handle, or may be affixed to the handle after molding. If form molded the handle 14 of the handle extension 10 may be of the same or greater width than the fixed angle elongated body 12. Preferably the handle 14 is not less than about 1 inch in diameter and not more than about 1¾ inches in diameter. Most preferably about 1½ inches in diameter. For ease of use, the handle 14 may be made in a variety of configurations that reduce the weight of the device. For example the handle 14 may be hollow axially along its length such as being tubular. Correspondingly the handle 14 could be hollow axially from side to side providing a gripping area for the palm and fingertips and being hollow in between. Alternatively the handle 14 may have a configuration that is more ergonomically desirable for the user. Such a handle 14 could be form molded to fit more precisely into the closed palm of the users hand, having for example indentations for fingers on one side and a raised area on the other to actively fill the cavity formed in the palm when the hand is grasping.

If the gripping means is provided after form molding it may be provided in one or more handle portions and made of a material that enhances the users ability to grip the handle extension 10. For example the gripping means may be made of a flexible rubber that increases gripping and that can be fitted to, or over the handle 14 end of the handle extension 10. Affixing the handle portions to the handle extension 10 may be done in a variety of ways including but not limited to passive attachment such as a rubber sleeve that fits tightly over the handle 14 end of the handle extension 10 or by active attachment such as by adhesive.

The length and width of the handle portion will depend on the width of the average user's hand and the configuration of the handle 14 end of the handle extension 10 that will receive the handle portion. Preferably the length is not less than about 3 inches and not more than about 8 inches, more preferably it is not less than about 4 inches and not more than about 6 inches and most preferably about 4½ inches. The width of the handle portion is preferably not less than ¾ inches in diameter and not more than 2 inches in diameter, more preferably not less than about 1 inch and not more than about 1¾ inches and most preferably about 1¼ inches.

Assembly

The present invention may be provided in fully assembled form or in a form that requires a minimum of assembly. Preferably, the manufacturer fabricates the device and markets it in fully assembled and packaged form. However, the device could be provided with a set of interchangeable handles that provide comfort of use to a larger portion of the population. These handles may be provided as a flexible sleeve or snap on pieces that allows the user to select a desirable handle length, texture and/or diameter. In this configuration the user may select a particular handle based on length, grip and diameter and slip the flexible sleeve over, or snap the handle portions into place on, the handle end of the handle extension prior to use.

Use

The device may be received in fully assembled form or in a form that requires a minimum of assembly. If no assembly is required prior to use the user obtains a commercially available handheld razor or applicator and positions it in the gripping head. Depending on the type of gripping head will depend on the action required by the user. If the gripping head comprises a rotating collar the user inserts the handle of the handheld razor or applicator into the hollow head of the gripping head and rotates the collar in a clockwise direction locking the handle of the razor or the applicator in the gripping head. If the gripping head comprises a slidable locking ring the user inserts the handle of the handheld razor or applicator into the gripping head and slides the locking ring toward the razor or applicator and into retaining flanges securing the razor or applicator in the gripping head. If the gripping head is a U-shaped adapter the user inserts the pin at the base of the adapter into the hollow handle of a handheld disposable razor or applicator or insert the end of the handle in the cavity and clips the neck of the handheld disposable razor or applicator into the C-shaped snap clip or three pronged snap clip at the top of the gripping head securing the razor or applicator in place.

Once the razor or applicator is in place the user may begin shaving or applying emulsions or medicaments to areas of the body that may be difficult for the user to reach. The user may also use the assistance of a mirror to view the areas of the body being reached with the handle extension of the present invention.

What is claimed:

1. A handle extension and a handheld razor or applicator pad to be held by said handle extension, wherein said handle extension comprise: a fixed angle elongated body having a handle at one end for holding and manipulating said fixed angle elongated body and a gripping head at the opposite end for releasably fastening a handle of said handheld razor or applicator pad, wherein said gripping head comprises an adapter having a pin on one end for receiving an open end of said handle of said handheld razor or applicator pad and a C-shaped snap clip on a second end to receive said handle of said handheld razor or applicator pad.

2. A handle extension and a handheld razor or applicator pad to be held by said handle extension, wherein said handle extension comprises: a fixed angle elongated body having a handle at one end for holding and manipulating said fixed angle elongated body and a gripping head at the opposite end for releasably fastening a handle of said handheld razor or applicator pad, wherein said gripping head comprises an adapter having a cavity on one end for receiving said handle of said handheld razor or applicator pad and a C-shaped snap clip on a second end for receiving a neck of a handheld razor or applicator pad.

3. A handle extension according to claims 1 or 2, wherein said C-shaped snap clip receives a neck of said handle of said handheld razor or applicator pad.

4. A handle extension according to claims 1 or 2, wherein said handle of said handle extension is hollow.

5. A handle extension and a handheld razor or applicator pad to be held by said handle extension, wherein said handle extension comprises: a fixed angle elongated body having a handle at one end for holding and manipulating said fixed angle elongated body and a gripping head at the opposite end for releasably fastening a handle of said handheld razor or applicator pad, wherein said gripping head comprises: a pin for receiving an open end of said handle of said handheld razor or applicator pad; and a snap clip for receiving a neck of said handle of said handheld razor or applicator pad.

6. A handle extension and a handheld razor or applicator pad to be held by said handle extension, wherein said handle extension comprises: a fixed angle elongated body having a handle at one end for holding and manipulating said fixed angle elongated body and a gripping head at the opposite end for releasably fastening a handle of said handheld razor or applicator pad, wherein said gripping head comprises: a cavity for receiving said handle of said handheld razor or applicator pad; and a snap clip for receiving a neck of said handle of said handheld razor or applicator pad.

* * * * *